US007040375B2

(12) United States Patent
Plötz et al.

(10) Patent No.: US 7,040,375 B2
(45) Date of Patent: May 9, 2006

(54) DIECASTING MACHINE AND PLUNGER LUBRICATING METHOD

(75) Inventors: Georg Plötz, Pliening (DE); Johann Fackler, Siegertsbrunn (DE); Elisabeth Wenzel, Müchen (DE)

(73) Assignee: Alcan Technology and Management Ltd., Neuhausen am Rheinfall ( * ) Notice: Subject to any disclaimer, the term of this patent is extended or adjusted under 35 U.S.C. 154(b) by 0 days.

(21) Appl. No.: 10/504,904

(22) PCT Filed: Feb. 1, 2003

(86) PCT No.: PCT/EP03/01001

§ 371 (c)(1),
(2), (4) Date: Mar. 21, 2005

(87) PCT Pub. No.: WO03/070400

PCT Pub. Date: Aug. 28, 2003

(65) Prior Publication Data

US 2005/0167070 A1 Aug. 4, 2005

(30) Foreign Application Priority Data

Feb. 19, 2002 (EP) ..... 02405125

(51) Int. Cl.
*B22D 17/08* (2006.01)

(52) U.S. Cl. ..... 164/72; 164/149; 164/312; 164/158; 164/267

(58) Field of Classification Search ..... 164/72, 164/149, 312, 158, 267
See application file for complete search history.

(56) References Cited

U.S. PATENT DOCUMENTS

| | | | | |
|---|---|---|---|---|
| 2,683,060 | A * | 7/1954 | Wise et al. | 417/547 |
| 4,257,902 | A * | 3/1981 | Singer | 508/185 |
| 5,028,366 | A * | 7/1991 | Harakal et al. | 264/51 |
| 5,601,774 | A * | 2/1997 | Kohama et al. | 264/338 |
| 6,354,359 | B1 * | 3/2002 | Perrella et al. | 164/72 |

* cited by examiner

*Primary Examiner*—Kevin Kerns
*Assistant Examiner*—I.-H. Lin
(74) *Attorney, Agent, or Firm*—Bachman & LaPointe, P.C.

(57) ABSTRACT

A diecasting machine comprising a movable and a stationary die half which, when closed, define a die cavity. The diecasting machine further comprises a filling chamber for receiving liquid metal, plunger, a slidingly displaceable inside the filling chamber and mounted on a plunger rod, for ejecting the liquid metal from the filling chamber and for injecting it into the die cavity, and a device for supplying lubricants for the plunger in the filling chamber. At least one pipe or one nozzle having an opening directed towards the plunger is fastened on the plunger rod. The pipe or the nozzle is linked with a reservoir for the lubricant via a supply line. A water-based releasing agent is sprayed into the intermediate space between the plunger rod and the cylindrical inner wall of the filling chamber in the direction of the plunger during a period in which the plunger is at its final lift position after the liquid metal has been injected into the die cavity.

10 Claims, 2 Drawing Sheets

DIECASTING MACHINE AND PLUNGER LUBRICATING METHOD

CROSS-REFERENCE TO RELATED APPLICATION

This application is a 371 of PCT/EP03/01001 filed on Feb. 1, 2003.

BACKGROUND OF THE INVENTION

The invention relates to a method for lubricating the piston in the filling chamber of a diecasting machine.

In a diecasting machine, liquid metal is metered into the filling chamber, ejected from the filling chamber with the piston and injected into the mould cavity. During this process, the piston sliding on the hot cylindrical inner wall of the filling chamber and its piston rings are subjected to high stresses. Lubrication of the piston is therefore essential.

Pistons which are conventional nowadays consist of a Cu—Be alloy or of steel. Piston greases and oils as well as granules or pellets are used as lubricants. Graphite-free or graphite-containing oils are applied by drop or spray lubrication. With drop lubrication, the application takes place on the piston while it is located at the beginning of its stroke. With spray lubrication, the piston is also located at the beginning of its stroke and spraying takes place through the metal filling aperture, in other words ahead of the piston.

The lubricants which are conventional nowadays are based on mineral oil and are therefore not very environmentally friendly.

A method of the type mentioned at the outset is disclosed in U.S. Pat. No. 5,370,171.

The invention is based on a first object of developing a method of the type mentioned at the outset in such a way that a piston lubricant is optimally applied to the piston and the inner wall of the filling chamber.

A second object of the invention is the provision of an improved lubrication method with an environmentally compatible lubricant. The method should at least achieve the lubricating properties of the lubricant based on mineral oil.

SUMMARY OF THE INVENTION

The object is achieved by providing a method for lubricating a piston in a filling chamber of a diecasting machine comprising a movable mould half and a fixed mould half which, in the closed position, delimit a mould cavity, a filling chamber for receiving liquid metal, a piston movable in a sliding manner in the filling chamber, located on a plunger rod, for ejecting the liquid metal out of the filling chamber and injecting it into the mould chamber, and a device for feeding lubricant for the piston into the filling chamber wherein a mould release agent based on water is sprayed in the direction of the piston into an interstice between the plunger rod and a cylindrical inner wall of the filling chamber for a period when the piston is at an end of its stroke after injection of the liquid metal into the mould cavity.

In a diecasting machine suitable for carrying out the method according to the invention at least one tube or a nozzle with an aperture directed towards the piston is fixed on the plunger rod and the tube or the nozzle is connected to a supply vessel for the lubricant by way of a feed line.

With the arrangement of a tube directly on the plunger rod, the lubricant can easily be applied to the piston and the inner wall of the filling chamber.

As the piston is sharply accelerated on injection of the liquid metal into the mould cavity, the mass of the parts fitted on the plunger rod should be kept as small as possible. The tube or the nozzle is therefore preferably produced from a thin metal tube or from a plastics material.

With a small spacing between the plunger rod and the inner wall of the filling chamber, it may prove to be expedient for the tube or the nozzle, and optionally a part of the feed line, to be arranged in a longitudinal groove in the piston rod.

The tube or the nozzle can be fastened to the plunger rod by means of at least one fastening element which should also have a mass which is as small as possible. Possible fastening elements are, for example, plastic material strips, such as for example cable binders, or pipe clamps made of plastics material or metal.

The mould release agent is preferably a polyethylene primary dispersion with anionic and non-ionogenic emulsifying agents, known by the commercial name HORDAMER PE 34. The mould release agent may also be waxes such as polyethylene wax and/or oils such as silicone oil.

The composition of the mould release agent is expediently selected such that a foam forms on injection into the filling chamber. This leads to an optimal wetting of the piston, or optionally the piston rings as well as the inner wall of the filling chamber. The excessive water/release agent mixture is removed on withdrawal of the piston from the filling chamber.

Very good wetting is achieved with a small lubricant mass owing to the dilution of the release agent with water. The cooling caused by the evaporation of the water leads to an extension in the service life of the filling chamber, the piston rings and the piston.

The mould release agent which is sprayed into the filling chamber advantageously contains 0.5 to 5% by weight solids, preferably 1 to 2% by weight solids and water as the remainder.

BRIEF DESCRIPTION OF THE DRAWINGS

Further advantages, features and details of the invention emerge from the following description of preferred embodiments and with the aid of the drawings, in which, schematically.

DETAILED DESCRIPTION

Figure 1:
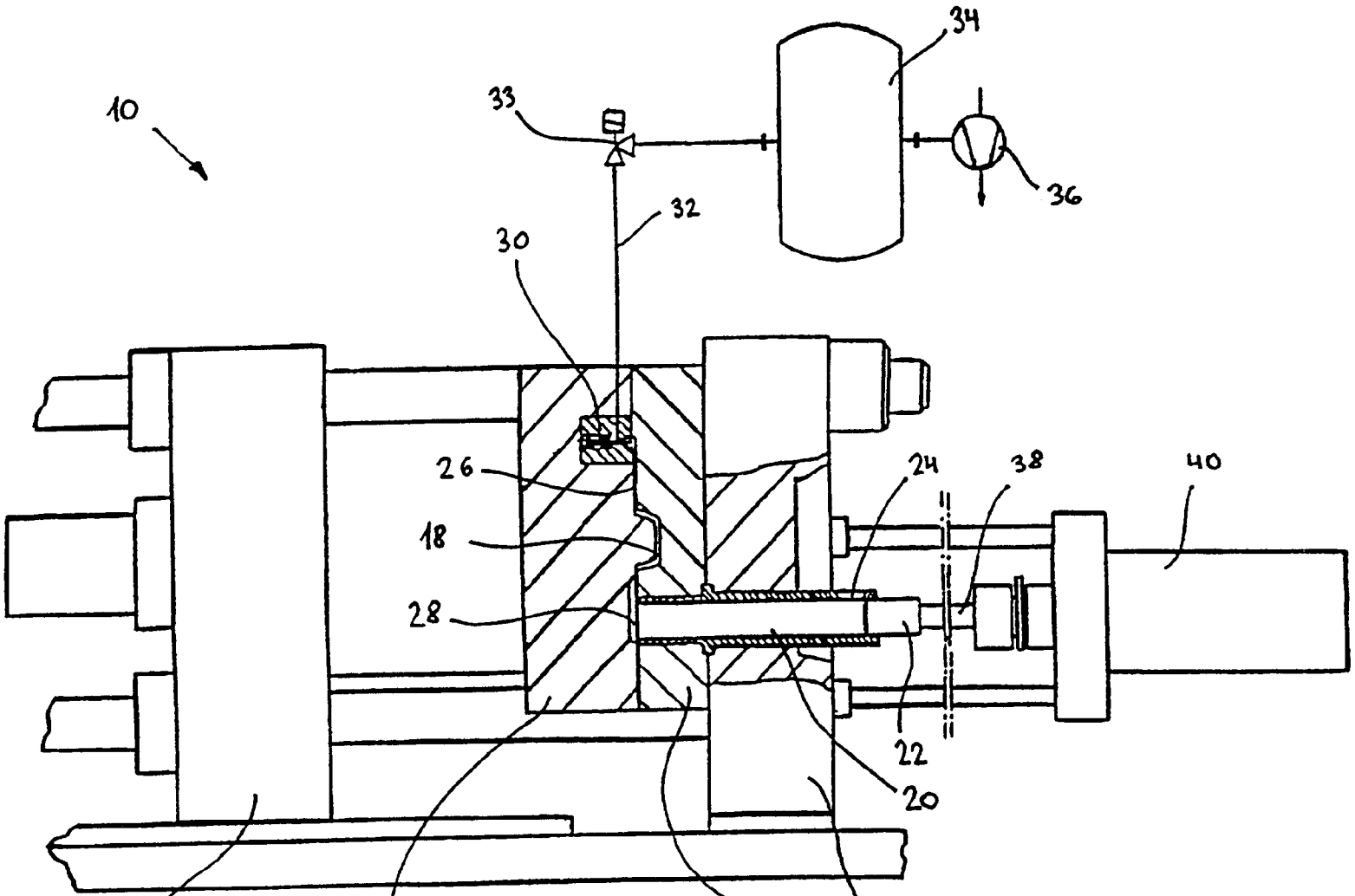
FIG. 1 shows a partial sectional side view of a diecasting machine.

A diecasting machine 10 shown in FIG. 1 for diecasting, for example, aluminium alloys has, respectively, a fixed mould half 14 clamped on a fixed machine plate.

12*a* and on a movable machine plate 12*b* and movable mould half 16 which delimit a mould cavity 18 in the closed position. A filling chamber 20, in which a piston 22 is displaceably arranged, extends into the fixed mould half 14. The filling chamber 20 can be filled manually or automatically with liquid metal by way of the aperture 24.

The mould cavity 18 is delimited on the side of the filling chamber 20 by a mould section 28, and on the opposing side, by a vacuum run or mould exit channel 26. The mould cavity 18 is connected by way of the mould exit channel 26 to a vacuum valve 30 which is in turn connected by way of a suction channel 32 and by way of a stop valve 33 connected in the suction channel 32 to a vacuum container 34. The vacuum container 34 is evacuated by means of a vacuum pump 36.

The piston 22 is located on a plunger rod 38 which is actuated axially in both directions by means of a hydraulic cylinder 40.

The piston 22 consists, for example, of a Cu—Be alloy and can be fitted with piston rings 42. The filling chamber 20 generally consists of steel.

Figure 2:
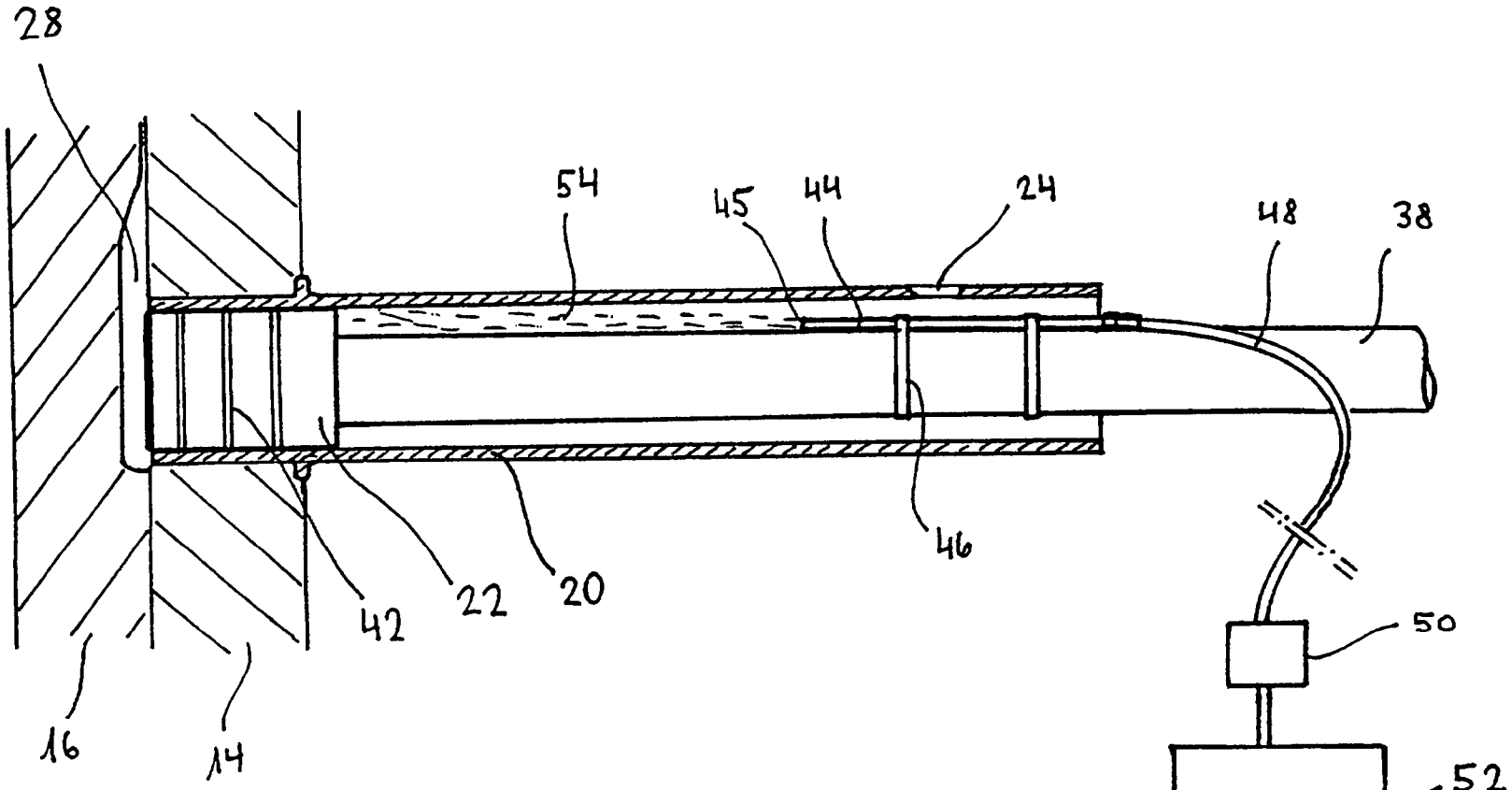
FIG. 2 shows a detail of the diecasting machine of FIG. 2.

According to FIG. 2, a tubular piece 44, for example in the form of a thin metal tube or made of plastics material, is fitted on the plunger rod 38. Fastening takes place by way of plastics material strips 46, for example in the form of cable binders or by way of pipe clamps. A flexible line 48, for example a plastics material hose or a flexible metal tube, connects the tube 44 with a supply vessel 52 for a release agent 54. A pressure amplifier 50 is connected into the flexible line 48.

FIG. 2 shows the position of the piston at the end of its stroke in the region of the mould notch 28, i.e. once injection of the liquid metal into the mould cavity 18 has taken place. In this position, the release agent/water mixture 54 is sprayed against the piston 22 from the aperture 45 of the tubular piece 44 directed towards the piston 22 inside the interstice between the plunger rod 38 and inner wall of the filling chamber 20. The plunger rod 38 is then withdrawn with the spray device fastened thereon and the piston 22 to prepare the next injection, until the piston 22 is at the beginning of its stroke. During this withdrawal of the piston 22, excess release agent/water mixture is ejected by means of the piston through the open end of the filling chamber 20. A thin release agent film therefore remains on the inner wall of the filling chamber once the remaining water has evaporated.

A comparative test carried out on the diecasting machine with an aluminium alloy has shown that the service life of pistons rings was about 300 injections with a conventional graphite-containing lubricant based on mineral oil, while with a mould release agent based on water, the service life could be increased to 15,000 injections.

The increase in the service lives of pistons, piston rings and filling chambers results in a lower replacement frequency for these parts and therefore a reduction in the standstill times of a diecasting machine.

The use of a mould release agent based on water for the piston lubrication, apart from a positive environmental aspect, has the advantage that the same release agent/lubricant can be used for the mould and for the filling chamber and the piston.

The invention claimed is:

1. Diecasting machine comprising a movable mould half and a fixed mould half which, in the closed position, delimit a mould cavity, a filling chamber for receiving liquid metal, a piston movable in a sliding manner in the filling chamber, located on a plunger rod, for ejecting the liquid metal out of the filling chamber and injecting it into the mould chamber, and a device for feeding lubricant for the piston into the filling chamber wherein at least one element with an aperture directed towards the piston is fixed on the plunger rod, and the element is connected to a supply vessel for the lubricant by way of a feed line.

2. Diecasting machine according to claim 1 wherein the element is arranged in a longitudinal groove in the plunger rod.

3. Diecasting machine according to claim 1 wherein the element is fastened to the plunger rod by means of at least one fastening element.

4. Method for lubricating a piston in a filling chamber of a diecasting machine comprising a movable mould half and a fixed mould half which, in the closed position, delimit a mould cavity, a filling chamber for receiving liquid metal, a piston movable between a start stroke position and an end stroke position in a sliding manner in the filling chamber, located on a plunger rod, for ejecting the liquid metal out of the filling chamber and injecting it into the mould chamber, and a device for feeding lubricant for the piston into the filling chamber wherein a mould release agent based on water is sprayed in the direction of the piston into an interstice between the plunger rod and a cylindrical inner wall of the filling chamber for a period when the piston is at the end stroke position after injection of the liquid metal into the mould cavity.

5. Method according to claim 4, wherein the mould release agent comprises a polyethylene primary dispersion with anionic and non-ionogenic emulsifying agents.

6. Method according to claim 5, wherein the mould release agent further comprises at least one of waxes and oils.

7. Method according to claim 4 wherein the mould release agent is sprayed as a foam into the filling chamber.

8. Method according to claim 4 wherein the mould release agent which is sprayed into the filling chamber comprises 0.5 to 5% by weight solids, and water as the remainder.

9. Method according to claim 4 wherein the mould release agent, on withdrawal of the piston to the start stroke position, is distributed uniformly on the wall of the filling chamber and excess mould release agent is removed from the filling chamber.

10. Method according to claim 4 wherein the mould release agent which is sprayed into the filling chamber comprises 1 to 2% by weight solids, and water as the remainder.

* * * * *